United States Patent [19]

Wolfe

[11] 4,351,458

[45] Sep. 28, 1982

[54] ROTARY THREAD SPOOL STORAGE TREE

[76] Inventor: Jack L. Wolfe, 13314 SE. Oatfield Rd., Milwaukie, Oreg. 97222

[21] Appl. No.: 232,563

[22] Filed: Feb. 9, 1981

[51] Int. Cl.[3] ..... A41H 31/00

[52] U.S. Cl. ..... 223/106; 211/59.1; 211/77; 211/163; 242/139

[58] Field of Search ..... 211/163, 59.1, 77, 196; 242/139; 223/106; D3/23, 24

[56] References Cited

U.S. PATENT DOCUMENTS

| | | | |
|---|---|---|---|
| 753,085 | 2/1904 | Maas et al. | 242/139 |
| 1,575,129 | 3/1926 | Schenck | 242/139 |
| 2,532,654 | 12/1950 | Zierold et al. | 223/106 |
| 2,944,761 | 7/1960 | Best | 242/139 |
| 4,029,241 | 6/1977 | Krake | 223/106 |

*Primary Examiner*—Henry F. Epstein
*Attorney, Agent, or Firm*—Oliver D. Olson

[57] ABSTRACT

A rotatable thread spool storage tree comprises a vertically extending post which carries a plurality of vertically spaced groups of limbs, the limbs of each group projecting outwardly from the post and being disposed 90° apart. Each limb mounts an arm which is disposed 90° relative to its limb so that the spool mounted thereon bears flush against the associated limb. The arrangement provides for a maximum number of limbs and arms in a given length of post, thereby providing for the storage of a maximum number of thread spools of conventional or large size, or a combination of the two, together with their bobbins, in a minimum of space.

7 Claims, 4 Drawing Figures

ROTARY THREAD SPOOL STORAGE TREE

BACKGROUND OF THE INVENTION

This invention relates to thread spool storage devices, and more particularly to a rotary storage tree which, by arrangement of storage arms and limbs relative to a center rotary post, provides for the holding of a maximum number of thread spools in a given length of post.

Devices for the storage of thread spools have been provided heretofore. U.S. Pat. Nos. 1,575,129 Schenk; 2,532,654 Zierold et al; and 4,029,241 Krake disclose such holders. The holder disclosed by Schenk provides a central upright secured to a base, the upright comprising a plurality of wires twisted and bent to form a plurality of laterally extending and vertically spaced branches each of which includes a plurality of spool supporting spindles, each succeeding lower branch having a greater number of spindles than the branch immediately above.

The spool holder of Zierold et al provides a plurality of vertically and laterally spaced spool fingers which are struck out from portions of vertically spaced sheet metal shelf plates.

Krake discloses a spool holder in which a vertical post supports a plurality of outwardly extending spool supporting arms.

SUMMARY OF THE INVENTION

In its basic concept, the spool holder of this invention utilizes a plurality of spool storage limbs radiating outwardly from a center post in longitudinally spaced groups of four limbs each, disposed 90° apart, each limb mounting a spool holding arm of sufficient length to hold a spool of thread and a bobbin.

It is by virtue of the foregoing basic concept that the principal objective of this invention is achieved; namely, the provision of a thread spool storage tree in which a maximum number of spool holding limbs are arranged along a given length of center post, thereby allowing for the efficient storage and presentation of a maximum number of thread spools and respective bobbins in a minimum of space.

It is a further object of this invention to provide a rotary thread spool storage tree of the class described in which cabinetry may be arranged about the tree, and the tree may be rotated therein so as to present desired spools to the user while preventing unintentional dislocation of the remainder should the assembly be upset.

A further object of this invention is the storage of conventional spools of either regular or large sizes or any combination of both, and their associated sewing machine bobbins.

A still further object of this invention is the provision of a thread spool storage tree which is of simplified construction for economical manufacture.

The foregoing and other objects and advantages of this invention will appear from the following detailed description, taken in connection with the accompanying drawings of preferred embodiments.

DESCRIPTION OF THE PREFERRED EMBODIMENTS

Figure 2:
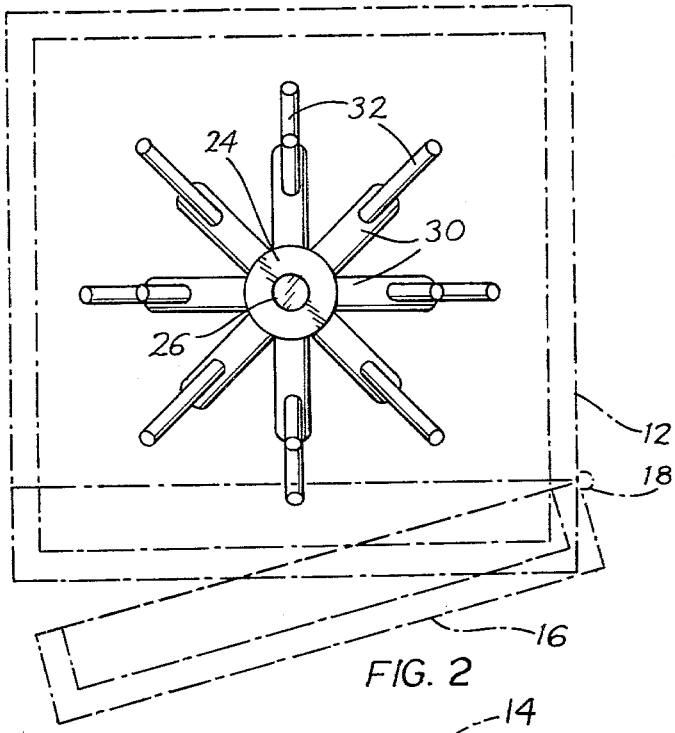
FIG. 2 is a plan view of the storage tree of FIG. 1 showing the arrangement of the post and associated limb members in the storage cabinet.

The thread spool storage tree of this invention is illustrated in the drawings as being mounted in a cabinet formed of a base 10, side and back walls 12, a top wall 14, and a door 16 movably connected to one side wall by hinges 18. Arranged centrally on the base 10 is a pivot peg 20, and another pivot peg 22, slightly longer, is centrally provided in the top 16.

Figure 1:
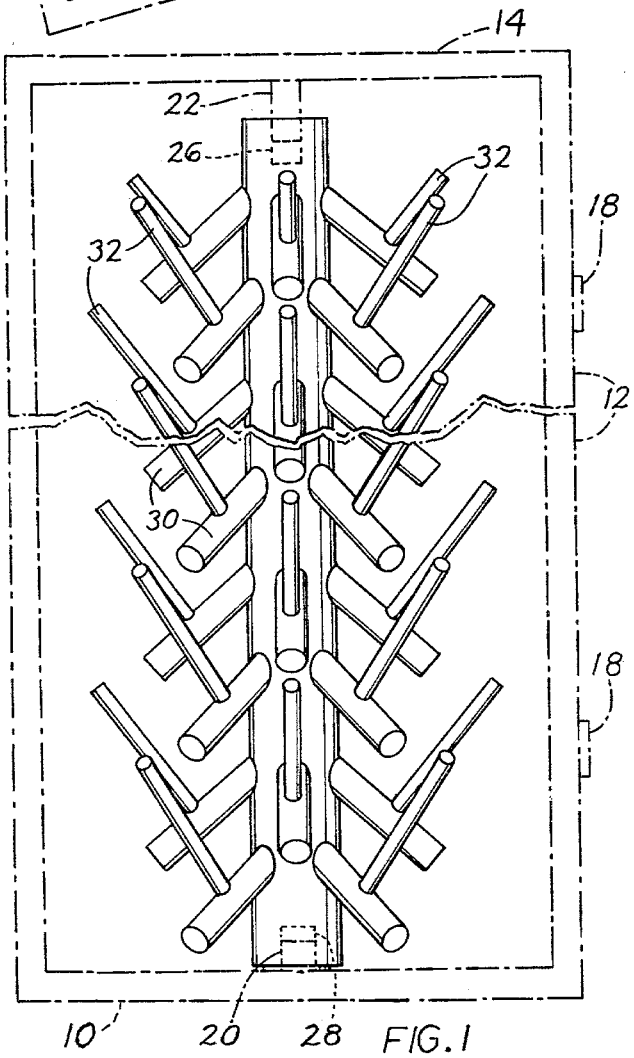
FIG. 1 is a foreshortened front elevation of a spool storage tree embodying the features of this invention, the tree being associated with a cabinet shown in broken lines and illustrating the angular and radially offset arrangement of the limb groups used for the storage of regular size spools.

The tree of FIGS. 1 and 2, arranged for receiving regular size spools of thread, includes a central post member 24 which incorporates centrally located axial bores 26 and 28 in its ends for rotational and removable engagement with pivot pegs 20 and 22. As illustrated, the upper bore 26 is configured deeper into the post 24 in order that the post may be lifted slightly, thereby disengaging the lower pivot peg 22 from the lower bore for removal of the post from the cabinet, if desired.

The tree as shown in FIGS. 1 and 2 includes a plurality of limbs 30 arranged along the length of the post 24 at longitudinally spaced intervals in groups of four limbs each, disposed at 90° intervals around the post. As illustrated, the limbs are angled downwardly, forming with the post an included angle of preferably about 40 degrees, and the limbs of each group of limbs are displaced circumferentially 45 degrees from the limbs of its adjacent group. In this manner a maximum number of limbs may be provided along a given length of post.

Each limb 30 supports an upwardly and outwardly extending arm 32 which is disposed at 90° relative to its associated limb. The axis of each arm is disposed in a plane which extends through the axis of its associated limb and the axis of the post 24. The arm serves to mount a regular size spool, and it is of sufficient length to project upwardly from the spool to receive a sewing machine bobbin for storage.

Figure 4:
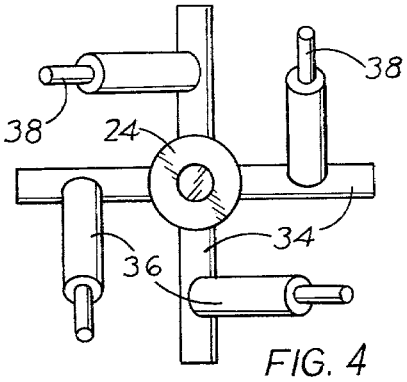
FIG. 4 is a plan view of the tree of FIG. 3 showing the symmetrical arrangement of the limb groups.
Figure 3:
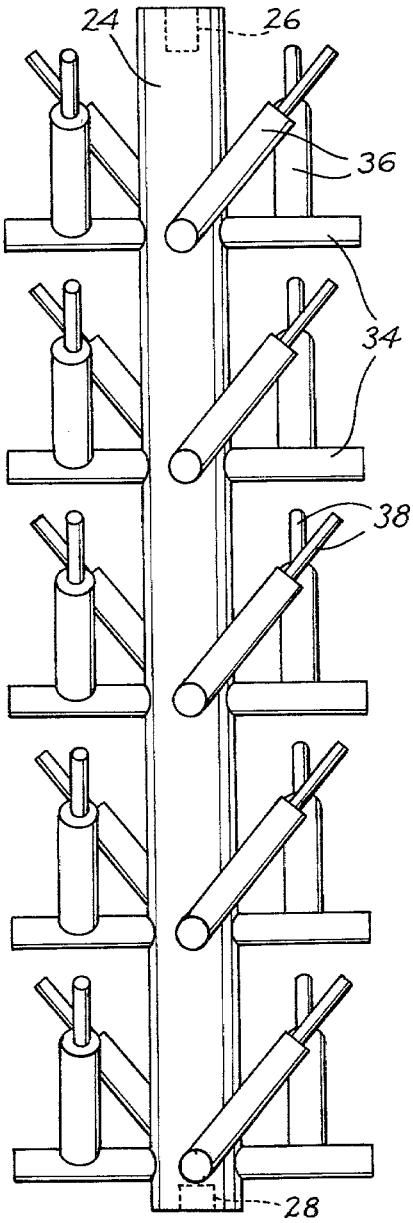
FIG. 3 is a side elevation of a second embodiment of the storage tree of this invention showing the arrangement of limbs and arms configured to receive large size spools.

FIGS. 3 and 4 illustrate a second embodiment of the storage tree, with limbs and arms configured to receive large size spools and yet their conventional sewing machine bobbins. The central post 24 mounts limbs 34 arranged in vertically spaced groups of four limbs each disposed at 90° intervals around the post, as previously described. However, the limbs project perpendicularly from the post, and each group is symmetrically in line with its adjacent groups.

Each limb mounts an arm 36 disposed substantially 90° relative to its limb so that the spool mounted thereon bears flush against the associated limb. However the arm extends angularly upward and outward, forming with a plane extended through the axis of the associated limb and the axis of post 24 an included angle of about 40°. This arrangement accommodates a maximum number of large spools in a minimum of space. The outermost portion 38 of each arm 36, as illustrated, is reduced in diameter to receive a bobbin for storage.

To illustrate the effectiveness of the foregoing structural arrangement, the embodiment of FIGS. 1 and 2 affords the storage of 48 regular size thread spools (3.5 cm diameter by 4.5 cm long) and associated bobbins using a center post 40 cm long by 3 cm diameter, 12 groups of limbs 30 of four limbs each 1 cm diameter and 5.4 cm long and 48 associated arms 32 of 0.5 cm diameter and 1 cm long. The embodiment of FIGS. 3 and 4 affords the storage of 20 large size thread spools (5 cm diameter by 6.4 cm long) and associated bobbins using the same center post dimensions as above, 5 groups of limbs 34 of four limbs each 1.25 cm diameter and 5.4 cm long and 20 associated arms having an inner section 36 of 1.25 cm diameter and 5.4 cm long and an outer section 38 of 0.5 cm diameter and 2.5 cm long.

The use and operation of the thread spool storage tree described above is as follows: The cabinet door 16 is opened and the axial bores 26 and 28 of a desired tree are placed in rotational engagement with the pegs 20 and 22 projecting inwardly from the base and top wall of the cabinet. Loading and unloading of thread spools is accomplished by rotating the tree so that the desired arms and spools are presented centrally in the door opening. Those spools are positioned directly forward are maintained on the arms against inadvertent displacement by the limited space defined by the confining walls of the cabinet. When the door of the cabinet is closed, all spools are confined to their respective support arms and, therefore, inadvertent tipping of the cabinet will not result in spillage of the spools.

It will be apparent to those skilled in the art that various changes may be made in the size, shape, type, number and arrangement of parts described hereinbefore. For example, the trees have been described and illustrated as providing storage of either regular or large size spools. It will be understood however, that a center post may incorporate any desired combination of the described limb groups for storing any desired number of regular spools and large spools. Thus, for example, one or more limb groups for large spools may be supported at the top or bottom portion of the post, or both, with the remaining limb groups being of the type for supporting regular size spools. Other arrangements may be made, as desired. The number of spools of thread provided for storage is dependent and limited by varying lengths of center post. The interior of the cabinet may be configured with various appropriate receptacles for storing other items such as scissors, pins, needles, tape, etc. The cabinet may be omitted and the post and limb and arm assembly simply mounted, fixed or rotatably, on a supporting base. The foregoing and other changes may be made without departing from the spirit of this invention and the scope of the appended claims.

Having thus described my invention, and the manner in which it may be used, I claim:

1. A thread spool storage tree, comprising:

(a) a base, (b) an elongated, vertically extending post member mounted on said base, (c) outwardly projecting limb members arranged along the length of the post member in longitudinally spaced groups each of a plurality of limb members disposed at circumferentially spaced intervals around said post, and (d) an upwardly and outwardly extending spool holding arm member supported on each said limb member, (e) the arm and limb members being arranged on the post to allow installation and removal of each spool without interference from spools on adjacent arm and limb members.

2. The thread spool storage tree of claim 1 wherein said post member is mounted on the base for rotation relative thereto.

3. The thread spool storage tree of claim 2 including a multi-sided containment cabinet about said storage tree, the base forming the bottom of the cabinet.

4. The thread spool storage tree of claim 1 wherein the limb members of each group are displaced circumferentially about the center post member 45° from the limb members of its adjacent group, and each said limb member in each group is arranged to project outwardly and downwardly, forming an included angle with the center post member of about 40°, and each said arm member projects upwardly and outwardly at about 90° relative to its associated limb member, and is of sufficient length to hold a thread spool and a bobbin.

5. The thread spool storage tree of claim 1 wherein the limb members of each group are arranged around the center post member vertically in line with the limb members of its adjacent limb group, each limb member is arranged to project substantially perpendicularly from the post member, each arm member projects upwardly at about 90° relative to its associated limb member and angularly outward from a plane extended through the axes of its limb member and post member, each arm member is configured to mount a large size thread spool, and the outer portion of each arm member is reduced in diameter to receive a bobbin for storage.

6. The thread spool storage tree of claim 4 wherein said post member is mounted on the base for rotation relative thereto.

7. The thread spool storage tree of claim 5 wherein said post member is mounted on the base for rotation relativethereto.

* * * * *